US005179795A

United States Patent [19]

Nakamura et al.

[11] Patent Number: 5,179,795

[45] Date of Patent: Jan. 19, 1993

[54] DEVICE FOR STRAIGHTENING ONE EDGE OF RECTANGULAR SHEET

[75] Inventors: Yoshizo Nakamura, Takamatsu; Kenzo Oyabu, Marugame; Nakanori Tomozawa, Takamatsu, all of Japan

[73] Assignee: Tokai Co., Ltd., Japan

[21] Appl. No.: 781,838

[22] Filed: Oct. 24, 1991

[51] Int. Cl.[5] ..... D06F 67/04; B65H 9/12

[52] U.S. Cl. ..... 38/143; 198/373; 271/225; 271/227; 271/235

[58] Field of Search ..... 38/7-12, 38/143; 198/464.3, 465.4, 373, 382, 394; 223/37; 271/3, 7, 12, 13, 225, 226, 227, 233-240

[56] References Cited

U.S. PATENT DOCUMENTS

| | | | |
|---|---|---|---|
| 1,912,724 | 6/1933 | Remington | 38/8 |
| 3,431,665 | 3/1969 | Weir | 38/143 |
| 3,464,131 | 9/1969 | McCabe | 38/143 |
| 3,604,132 | 9/1971 | Thompson et al. | 38/143 |
| 3,735,512 | 5/1973 | Ross | 38/143 |
| 3,756,588 | 9/1973 | Gerstenberger | 38/143 X |
| 4,050,173 | 9/1977 | Olsen | 38/143 |
| 4,106,227 | 8/1978 | Allen et al. | 38/143 |
| 4,685,664 | 8/1987 | Peterdorf | 271/227 |
| 4,726,501 | 2/1988 | Wiley | 271/227 X |
| 4,805,892 | 2/1989 | Calhoun | 271/227 X |
| 4,885,853 | 12/1989 | McCabe | 38/8 XR |
| 5,021,673 | 6/1991 | Dragon et al. | 271/227 X |

FOREIGN PATENT DOCUMENTS

| | | | |
|---|---|---|---|
| 0053562 | 6/1982 | European Pat. Off. | 38/8 |
| 0274000 | 7/1988 | European Pat. Off. | 38/12 |
| 0160903 | 6/1984 | Fed. Rep. of Germany | 38/7 |
| 0272768 | 6/1984 | Fed. Rep. of Germany | 38/143 |
| 2099025 | 12/1982 | United Kingdom | 38/8 |
| 2219313 | 12/1989 | United Kingdom | 38/143 |

*Primary Examiner*—Werner H. Schroeder
*Assistant Examiner*—Ismael Izaguirre
*Attorney, Agent, or Firm*—Lorusso & Loud

[57] ABSTRACT

A device for straightening one edge DA of the four side edges AB, BC, CD and DA of a flexible sheet such as a crumpled bed sheet disclosed. One corner A of the sheet and a portion of the edge AB are held by a pair of laterally spaced apart, left and right holders mounted on a movable member so that the sheet is displaced on an elongated plate along the longitudinal direction thereof by the movement of the movable member. One or more laterally extending endless conveyers belts are provided on the plate to laterally move the sheet on the plate. A detector is provided to determine the direction of the movement of each of the conveyors, so that the edge DA is made in parallel with the longitudinal direction of the plate.

4 Claims, 7 Drawing Sheets

DEVICE FOR STRAIGHTENING ONE EDGE OF RECTANGULAR SHEET

BACKGROUND OF THE INVENTION

1. Field of the Invention

This invention relates to a device for straightening one side edge of the four side edges of a rectangular flexible sheet.

2. Prior Art

Laundry shops generally use automatic machines for pressing and folding relatively large rectangular flexible sheets such as bed sheets, quilt covers and bed covers, which have been washed and dried. Since such a rectangular sheet to be processed by the press machine is generally in a crumpled state, it is necessary to straighten one of the four edges thereof before the sheet is fed to the machine. Because of the large size of the sheet, it is difficult for a worker to perform the straightening operation by himself.

SUMMARY OF THE INVENTION

The present invention has been made to provide a device which can straighten one of the four side edges of a rectangular flexible sheet as mentioned above.

In accordance with one aspect of the present invention, there is provided a device for processing a rectangular flexible sheet having four vertices A through D to straighten one edge DA of the four edges AB, BC, CD and DA thereof, comprising:

a frame;

a plate secured to said frame and extending longitudinally from a front end to a rear end thereof, said plate having a first location adjacent to said front end and a second location adjacent to said rear end, said first and second locations being longitudinally spaced apart from each other with a distance greater than any of the edges of the flexible sheet, said front end being tapered to form a tapered tip end;

movable means supported on said frame and movable above said plate along the length of said plate;

a pair of laterally spaced apart, first and second holders for holding desired portions of the flexible sheet, each of said first and second holders being secured to said movable means for movement therewith, so that, upon movement of said movable means, said first and second holders move along predetermined, spaced apart, first and second lines, respectively, said tapered tip end of said plate being located between said first and second lines;

displacing means for moving said movable means;

conveyer means having a conveying surface laterally extending between one end and the other end such that said first line is located between said one end and said the other end and said second line is located between said first line and said the other end, said conveying surface being disposed above said plate and adapted to move laterally across the plate;

drive means for moving said conveyer means;

detector means for determining whether or not the flexible sheet on said conveyer means is present on said first line; and control means coupled to said detector means and said drive means to instruct said drive means to operate so that said conveying surface moves in the direction from said first line to said second line when said detector means detects the presence of the flexible sheet on said first line and in the direction from said second line to said first line when said detector means fails to detect the presence of the flexible sheet on said first line, whereby one vertex A of the four vertices A through D of the flexible sheet held by said first holder, with one intermediate portion P of the edge AB being held by said second holder, is moved on said plate through said first location to said second location upon the actuation of said displacing means with the edge DA of the flexible sheet being laterally displaced by said conveyer means and brought into parallel with said first line.

In another aspect, the present invention provides a device for processing a rectangular flexible sheet having four vertices A through D to straighten one edge DA of the four edges AB, BC, CD and DA thereof, comprising:

a frame;

a plate secured to said frame and extending longitudinally from a front end to a rear end thereof, said plate having a first location adjacent to said front end and a second location adjacent to said rear end, said first and second locations being longitudinally spaced apart from each other by a distance greater than any of the edges of the flexible sheet, said front end being tapered to form a tapered tip end;

movable means supported on said frame and movable above said plate along the length of said plate;

a pair of laterally spaced apart, first and second holders for holding desired portions of the flexible sheet, each of said first and second holders being secured to said movable means for movement therewith, so that, upon movement of said movable means, said first and second holders move along predetermined, spaced apart, first and second lines, respectively, said tapered tip end of said plate being located between said first and second lines;

displacing means for moving said movable means;

a plurality of juxtaposed conveyer means each having a conveying surface extending laterally from one end to the other end such that said first line is located between said one end and said the other end while said second line is located between said first line and said the other end, each of said conveying surfaces being disposed above said plate and arranged so that the total length of said conveying surfaces in the longitudinal direction of said plate is greater than the distance between said first and second locations of said plate, said conveying surfaces being adapted to move independently from each other transversely of the plate and having a reference line between said first line and said one end;

a plurality of drive means, corresponding in number to said plurality of conveyer means, for moving the corresponding conveying surfaces transversely of said plate;

a plurality of detector means, corresponding in number to said plurality of endless conveyer means, for determining whether or not the flexible sheet on respective conveyer means is present on said reference line; and control means coupled to said plurality of detector means and said plurality of drive means to instruct respective drive means to operate so that each of said conveying surfaces moves in the direction from said first line to said second line when the corresponding detector means detects the presence of the flexible sheet on said reference line and in the direction from said second line to said first line when the corresponding detector means fails to detect the presence of the flexible sheet on said reference line, whereby after one vertex A of the four vertices A through D of the flexible sheet, held by said first holder with one intermediate portion P of the edge AB being held by said second holder, has been moved across said conveying surfaces through said first location to said second location upon the actuation of said displacing means, the flexible sheet is laterally displaced by said conveyer means to make the edge DA thereof in parallel with said reference line.

BRIEF DESCRIPTION OF THE DRAWINGS

The present invention will now be described in detail below with reference to the accompanying drawings, in which.

DESCRIPTION OF THE PREFERRED EMBODIMENTS

Figure 7:
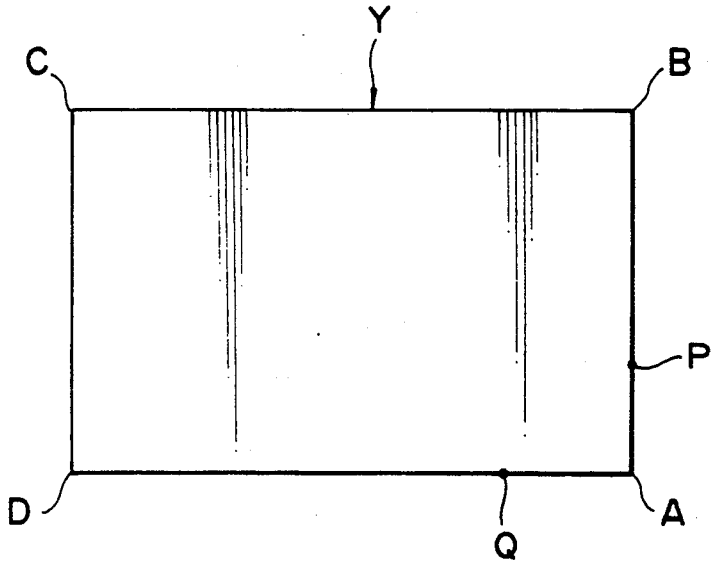
FIG. 7 is an example of flexible sheet in an extended state to be processed.

The present invention provides a device for processing a rectangular flexible sheet, generally designated as Y in FIG. 7 and having four vertices A through D, to straighten one edge DA of the four edges AB, BC, CD and DA thereof.

Figure 1:
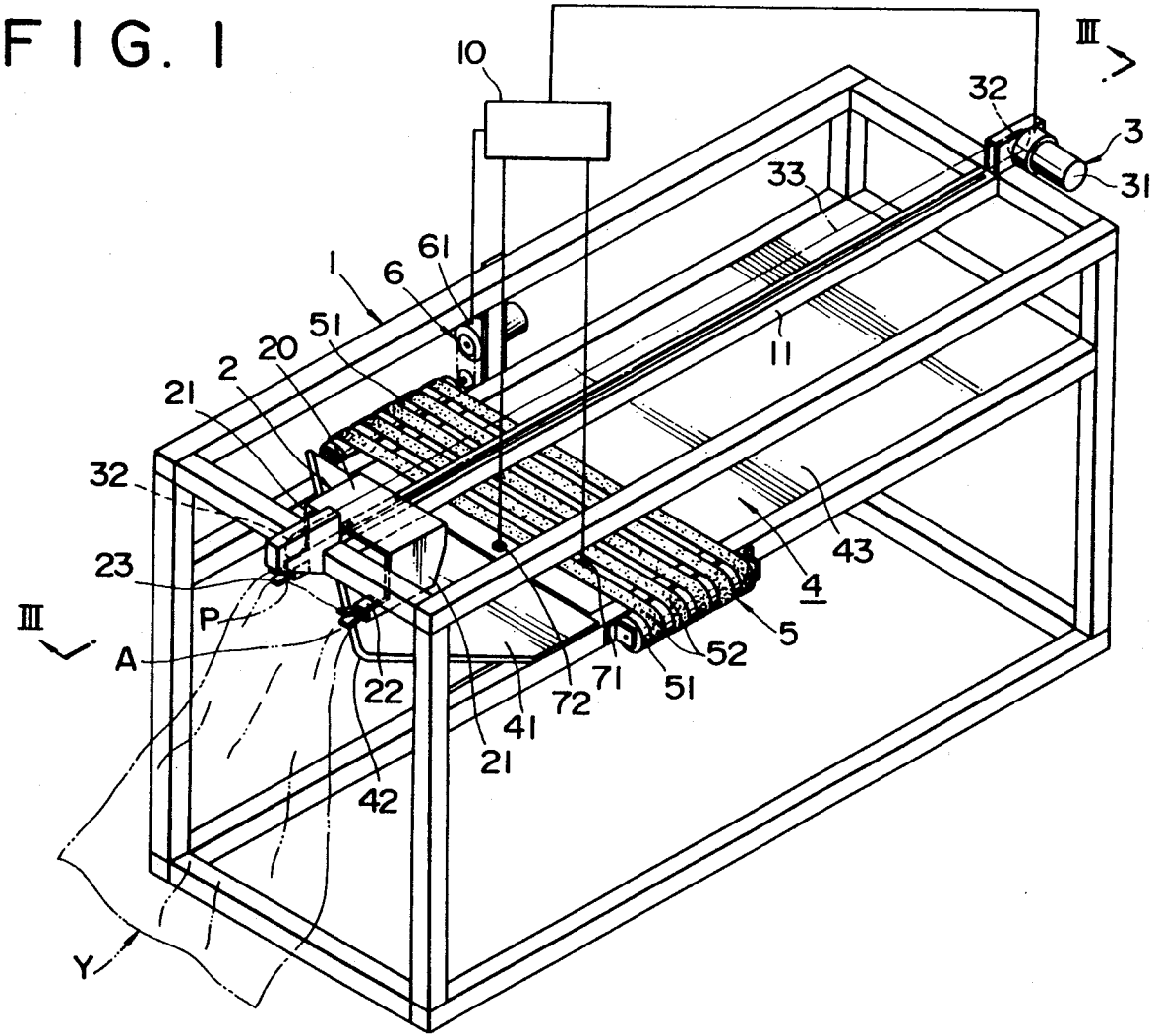
FIG. 1 is a perspective view diagrammatically illustrating one embodiment of the device according to the present invention.
Figure 2:
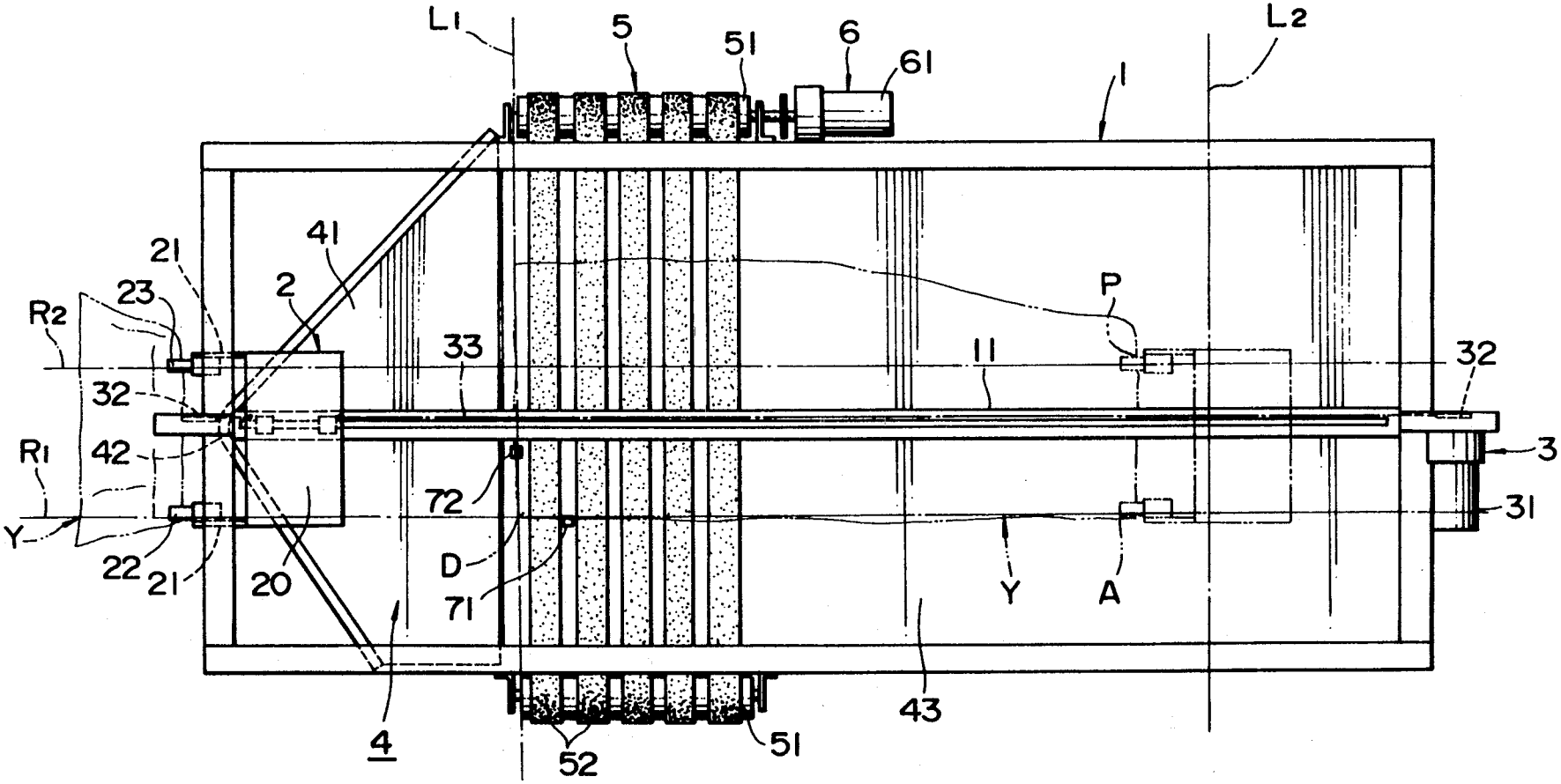
FIG. 2 is a plan view of FIG. 1.
Figure 3:
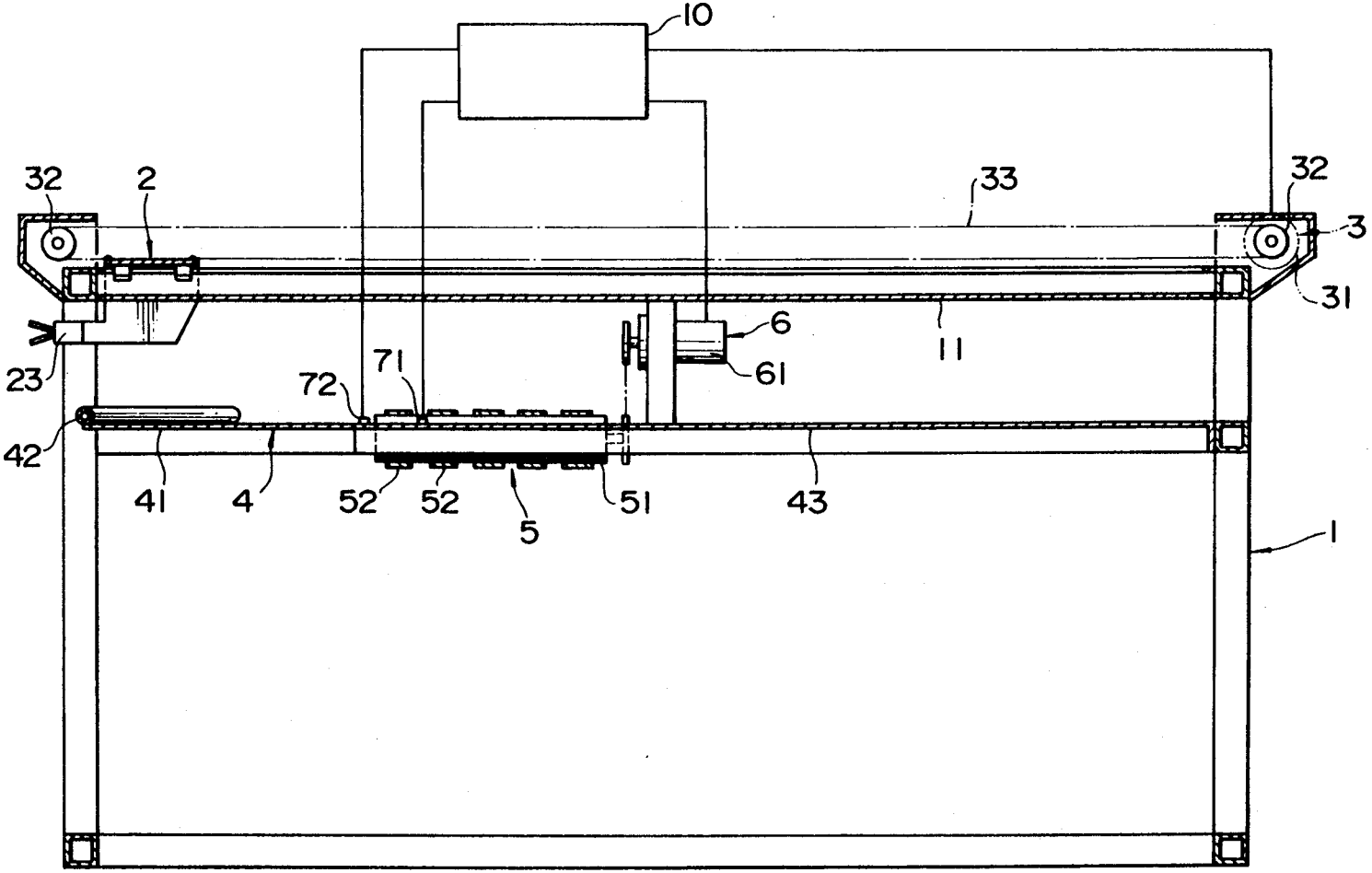
FIG. 3 is a cross-sectional view taken on lines III—III in FIG. 1.

Referring to FIGS. 1-3 which show one preferred embodiment of the present invention, designated generally as 1 is a frame to which an elongated plate 4 is secured. The plate 4 is composed of a front section 41 and a rear section 43. The front section 41 has a tapered front tip end 42. The rear section 43 has first and second locations $L_1$ and $L_2$ (FIG. 2) spaced apart from each other by a distance greater than any of the edges of the sheet Y.

The frame 1 has a guide rail 11 extending above the plate 4 and in parallel with the longitudinal direction of the plate 4. Mounted slidably on the rail 11 is a movable member 2 which has a top plate 20 and a pair of side plates 21 extending downwardly from the both sides of the top plate 20. A pair of spaced apart, right and left holders 22 and 23 are secured to the side plates 21. Each of the holders 22 and 23 is adapted to hold a portion of the flexible sheet Y. In the illustrated case, the right holder 22 holds the corner portion (vertex) A of the sheet Y while the left holder 23 holds an intermediate portion P of the edge AB (see FIG. 7). The holders 22 and 23 may be of any structure as long as they can firmly hold the sheet Y. An air chuck type holder adapted to be opened and closed by compressed air for releasing and clipping the sheet Y may be suitably used. For reasons of facilitating manual operation of attaching the sheet Y to the holders 22 and 23, it is preferred that the distance between the right and left holders 22 and 23 be about 40-60 cm.

Displacing means 3 is provided to displace the movable member 2 along the guide rail 11. As best seen from FIG. 3, a pair of sprocket wheels 32 are mounted on the opposite ends of the guide rail 11. The wheel 32 provided in the rear end of the rail 11 is operatively connected to a drive motor 31. A chain 33 is provided between the two wheels 32 for meshing therewith. Both ends of the chain 33 are fixed to the movable member 2 so that the movable member 2 is displaced forward and backward upon the driving of the motor 31 in either direction. Of course, for the purpose of the present invention, any other suitable mechanism may be adopted for the displacing means 3.

Thus, upon displacement of the movable member 2, the holders 22 and 23 are moved therewith. As seen from FIG. 2, the right and left holders 22 and 23 are moved along spaced apart, first and second lines $R_1$ and $R_2$ which position between the side edges of the plate 4 and between which the tapered tip end 42 is located. As a consequence, the sheet Y held by the two holders 22 and 23 is pulled and displaced on the plate 4 by the movement of the movable member with the vertex A thereof being moved along the first line $R_1$ of the movement of the right holder 22. The tapered end of the fore section 41 of the plate serves to laterally spread the sheet Y.

Conveyer means 5 is disposed adjacent to the fore section 41 of the plate 4. The conveyer means 5 in the illustrated embodiment includes four spaced apart endless belts 52 laterally extending between a pair of rollers 51 provided on both sides of the plate 4. The belts 52 are wound around the plate 4 to form on the plate 4 a conveying surface which crosses the first and second lines $R_1$ and $R_2$ along which the right and left holders 22 and 23 travel, respectively, as shown in FIG. 2. Drive means 6 is connected to one of the rollers 51 (left roller in the illustrated embodiment) to drive the left roller. The drive means 6 includes a sprocket and chain mechanism and a motor 61 to drive the sprocket. As a result of the above construction, the endless conveyer belts 52 are moved leftward or rightward upon revolution of the motor 61 in either direction. Thus, the sheet Y brought into supporting engagement with the belt conveyer 5 is moved laterally on the plate 4.

Detector means 71 is provided for determining whether or not the flexible sheet Y on the conveying surface is present on the first line $R_1$. The detector means 71 in the illustrated embodiment is a photoelectric tube disposed in the gap of the conveyer belts 52 just beneath the first line $R_1$. Thus, when the edge DA of the sheet Y on the conveying surface is located on the right side of the first line $R_1$, the detector 71 detects the presence of the sheet Y. Similarly, when the edge DA is located on the left side of the first line $R_1$, the detector 71 detects the absence of the sheet Y.

The detector means 71 and the drive means 6 are electrically coupled to control means 10. Thus, when the detector means 71 detects the presence of the flexible sheet Y, the control means 10 instructs the drive means 6 to operate so that the conveying surface (i.e. the conveyer belts 52 above the plate 4) runs leftward. On the other hand, when the detector means 71 detects the absence of the flexible sheet Y, the control means 10 instructs the drive means 6 to operate so that the conveyer belts 52 run rightward. By this, when the vertex A is moved along the first line $R_1$ of the right holder 22, succeeding trailed portions of the edge DA are continuously displaced leftward and rightward so that the edge DA is brought into parallel with the first line $R_1$ of the right holder 22.

Designated as 72 is sensor means for detecting the passage of the edge CD of the flexible sheet Y through the predetermined first location $L_1$ of the plate 4 so as to determine the completion of the displacement of the entire sheet Y on the plate 4. The sensor means 72 may be a photoelectric tube disposed near the center axis of the plate 4. The sensor means 72 and the displacing means 3 are also coupled to the control means 10 so that when the sensor means 72 detects the passage of the edge CD, the displacing means 3 stops operation to stop the movement of the movable means 2, namely to stop the longitudinal movement of the flexible sheet Y. Construction of the control means 10 is well known in the art and the explanation thereof is omitted here.

The above described device operates as follows. First, the control means 10 is operated to position the movable means 2 in the home position as shown in FIG. 1. An operator picks up desired one vertex A of the four vertices A, B, C and D of the flexible sheet Y with his right hand and then a desired portion P of the edge AB adjacent to the vertex A with his left hand. The sheet Y is then manually attached to the device as shown in FIG. 1 to start the straightening of the edge DA. Namely, the vertex A is held by the right holder 22 while the portion P of the edge AB is held by the left holder 23 with the edge AP being desirably slightly strained. Since the distance between the right and left holders 22 and 23 is nearly equal to the breadth of operator's shoulders, the attaching operation can be easily performed.

Figure 4:
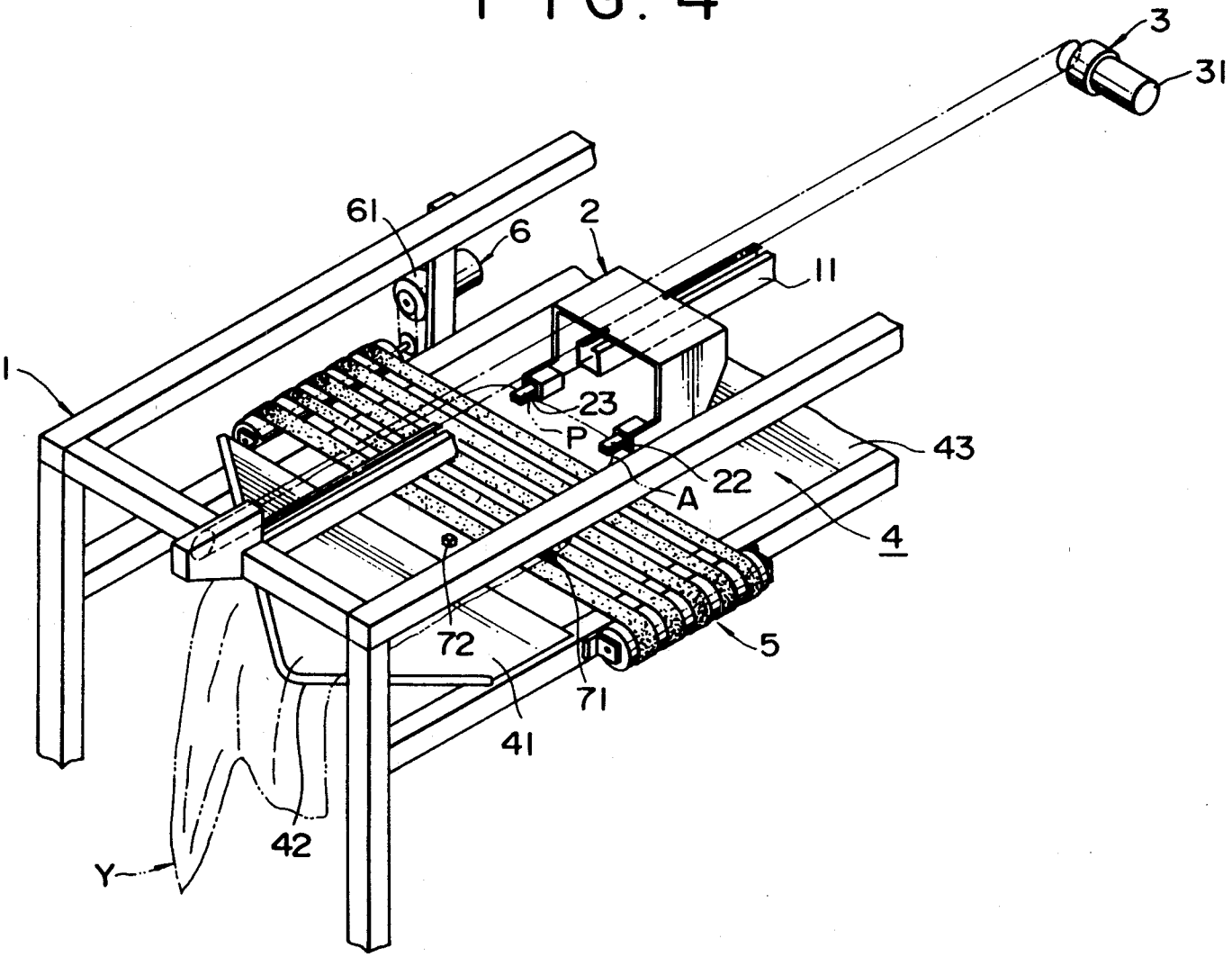
FIGS. 4 and 5 are fragmentary, perspective views showing the operation of the device of FIG. 1.

The operator then starts the straightening device. Thus, the movable means 2 is gradually displaced toward the rear end of the plate 4. The trailed portion of the sheet Y is engaged by the tapered end 42 of the plate 4 and is pulled so that the portion of the sheet Y adjacent to the edge DA is laterally and longitudinally spread as the movable means 2 is displaced (FIG. 4). When the sheet Y is located above the detector means 71, the conveyer means 5 is operated to displace the supported sheet Y leftward. In the absence of the sheet Y above the detector means 71, the conveyer means 5 shifts the supported sheet Y rightward. Thus, the trailing edge DA is aligned on the first line $R_1$ along which the right holder 22 holding the vertex A travels.

Figure 5:
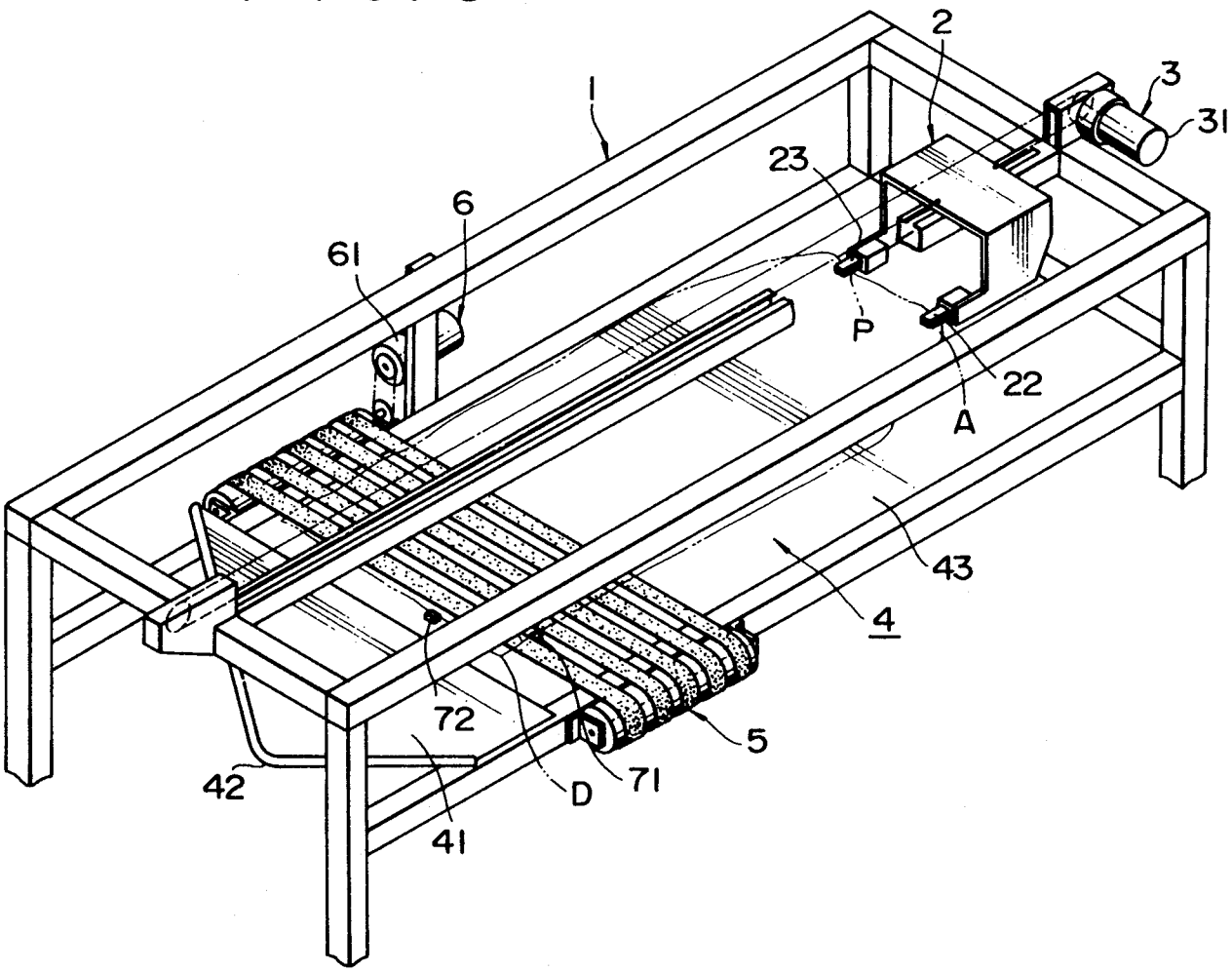

After the movable means 2 has moved edge CD above the sensor means 72 as shown in FIG. 5, the movable means is stopped at the second location $L_2$. Then, the holders 22 and 23 are opened to release the sheet Y. The sheet Y whose edge DA has been straightened is then fed to a next step such as a press machine. The movable means 2 is subsequently returned to the home position for the mounting of a new sheet.

In the above explanation, the sheet Y is processed for straightening the edge DA. It will be understood, however, when, in FIG. 7, a portion Q on the edge DA is attached to the left holder 23 in place of the portion P on the edge AB, then the edge AB is automatically straightened by the straightening device of the present invention.

Figure 6:
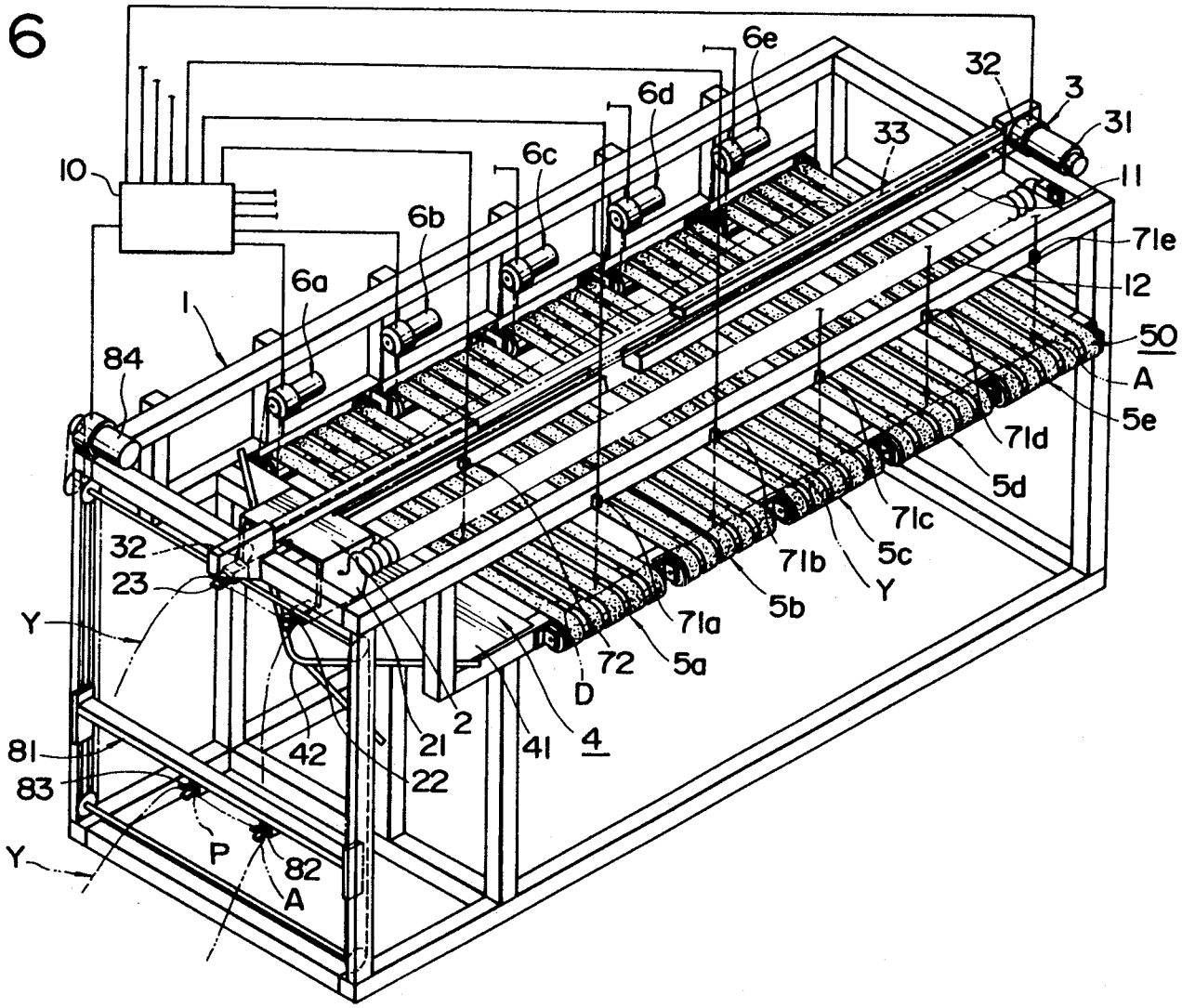
FIG. 6 is a perspective view, similar to FIG. 1, showing another embodiment of the present invention.

Another preferred embodiment of the straightening device of the present invention is shown in FIG. 6 in which the same reference numerals as those in FIG. 1 designate similar component parts. Explanation of the similar parts is not repeated here. The second embodiment differs from the above-described first embodiment in that its edge alignment means 50 is composed of a plurality (five in the specific embodiment shown) of juxtaposed conveyer means 5*a* through 5*e* embodiment.

Each of the conveyer means 5*a* through 5*e* has a conveying surface disposed above a plate 4 so that the total length of the conveying surfaces in the longitudinal direction of the plate 4 is greater than any of the four edges of the sheet Y. The conveying surfaces are adapted to run independently from each other laterally across the plate 4. A plurality of drive means 6*a* through 6*e*, corresponding in number to the conveyer means 5*a* through 5*e*, are provided for transversing the length of the plate 4.

Further, a plurality of detector means 71*a* through 71*e*, corresponding in number to the plurality of conveyer means 5*a* through 5*e* are provided for determining whether or not the flexible sheet Y on the corresponding conveying surface is present on a predetermined reference line positioned on the right side of and in parallel with the locus (first line $R_1$ in FIG. 2) of the movement of the right holder 22. The detector means 71*a* through 71*e* may be photoelectric tubes arranged in a row adjacent to the right side end of the conveying surfaces of the conveyer means 5*a* through 5*e*.

The detector means 71*a* through 71*e* and the drive means 6*a* and 6*e* are coupled to a control means 10. The control means 10 instructs respective drive means 5*a* through 5*e* to operate so that each of the conveying surfaces runs leftward when the corresponding detector means detects the presence of the flexible sheet Y on the reference line or rightward when the corresponding detector means does not detect the presence of the flexible sheet Y on the reference line.

The control means 10 in this second embodiment is so arranged that the drive means 6*a* through 6*e* are made operable only after the flexible sheet Y has been placed on the conveying surfaces of the conveyer means 5*a* through 5*e* throughout the length of the edge DA. This is achieved by utilization of the sensor means 72.

Thus, after the flexible sheet Y has been entirely placed on the conveyer belts by the movement of the movable means 2, conveyer means 5*a* through 5*e* start operation so that the the edge DA thereof is laterally displaced by the conveyer means 5*a* through 5*e* and brought into alignment with the reference line.

In FIG. 6, designated as 12 is an elastic pipe to supply compressed air to the holders 22 and 23 of an air chuck type construction for the actuation thereof. Designated as 81 is a laterally extending movable bar whose both ends are slidably received by the frame 1. Drive means including a motor 84 and a sprocket and chain mechanism is provided for vertically moving the bar 81 between a lower position and an upper position. The bar 81 has a pair of spaced apart holders 82 and 83 having a construction similar to the holders 22 and 23 and each adapted to hold a portion of the sheet Y.

The device shown in FIG. 6 operates as follows.

An operator first attaches a desired vertex A of the sheet Y and an intermediate portion P of the edge AB to the holders 82 and 83, respectively, when the bar 81 is in the lower position. Then the operator starts the motor 84 to hoist up the sheet Y. The bar 81 stops moving at the upper position. The operator transfers the sheet Y from the holders 82 and 83 to the holders 22 and 23 of the movable means 2. The above sheet hoist up mechanism is optional and may be omitted.

The operator then starts the straightening device. Thus, the movable means 2 is gradually displaced toward the rear end of the plate 4 in the same manner as described in connection with the first embodiment of FIG. 1. The trailed portion of the sheet Y is engaged by the tapered end 42 of the plate 4 and is pulled so that the portion of the sheet Y adjacent to the edge DA is laterally and longitudinally spread as the movable means 2 is displaced.

After the movable means 2 has been displaced so that the edge CD has passed above the sensor means 72, namely after the entire sheet Y has been displaced to a predetermined location on the plate 4, the movable means 2 is stopped. Then, the holders 22 and 23 are opened to release the sheet Y. The conveyer means 5*a* through 5*e* start operation to straighten the edge DA. Thus, when the sheet Y is located above the detector means 71, the conveyer means 5*a* through 5*e* are operated to displace the supported sheet Y leftward. In the absence of the sheet Y above the detector means 71, the conveyer means 5*a* through 5*e* shift the supported sheet Y rightward. Thus, the edge DA is aligned on the reference line beneath the row of the detectors 71*a* through 71*e*.

What is claimed is:

1. A device for straightening an edge (DA) of a rectangular flexible sheet having four vertexes (A through D) and four edges (AB, BC, CD and DA), comprising:

a frame;

a plate secured to said frame and extending longitudinally from a front end to a rear end thereof, said plate having a first location adjacent to said front end and a second location adjacent to said rear end, said first and second locations being longitudinally spaced apart from each other with a distance greater than a length of any of the edges of the flexible sheet, said front end being tapered and forming a tapered tip end;

movable means supported on said frame and movable above said plate along the longitudinal direction of said plate;

a pair of laterally spaced apart, first and second holders for holding predetermined portions of the flexible sheet, each of said first and second holders being secured to said movable means for movement therewith, wherein, upon movement of said movable means, said first and second holders move along predetermined, spaced apart, first and second paths, respectively, said tapered tip end of said plate being located between said first and second paths;

displacing means for moving said movable means;

conveyor means having a conveying surface laterally extending between one end and the other end of said plate such that said first path is located between said one end and said other end and said second path is located spaced from said first path and between said one end and said other end, said conveying surface being disposed above said plate and movable in the lateral direction of said plate;

drive means for moving said conveyor means;

detector means for detecting whether or not said edge (DA) of said flexible sheet on said conveyor means is present on said first path; and control means coupled to said detector means and said drive means for controlling said drive means such that said conveying surface moves in a direction from said first path to said second path when said detector means detects the presence of the edge (DA) of the flexible sheet on said first path and in a direction from said second path to said first path when said detector means does not detect the presence of the edge (DA) of the flexible sheet on said first path, whereby one vertex (A) of the four vertexes (A through D) of the flexible sheet held by said first holder and an intermediate portion (P) of an adjacent vertex (B) held by said second holder, are moved on said plate from said first location to said second location upon an actuation of said displacing means with the edge (DA) of the flexible sheet being laterally displaced by said conveyor means and straightened parallel to said first path.

2. The device as claimed in claim 1, further comprising sensor means for sensing a passage of a trailing edge (CD) of the flexible sheet through said first location, said sensor means being coupled to said control means so that when said sensor means senses the passage of said trailing edge (CD), the displacing means stops the movement of said movable means.

3. A device for straightening an edge (DA) of a rectangular flexible sheet having four vertexes (A through D) and four edges (AB, BC, CD and DA), comprising:

a frame;

a plate secured to said frame and extending longitudinally from a front end to a rear end thereof, said plate having a first location adjacent to said front end and a second location adjacent to said rear end, said first and second locations being longitudinally spaced apart from each other with a distance greater than a length of any of the edge of the flexible sheet, said front end being tapered and forming a tapered tip end;

movable means supported on said frame and movable above said plate along the longitudinal direction of said plate;

a pair of laterally spaced apart, first and second holders for holding predetermined portions of the flexible sheet, each of said first and second holders being secured to said movable means for movement therewith, wherein, upon movement of said movable means, said first and second holders move along predetermined, spaced apart, first and second paths, respectively, said tapering tip end of said plate being located between said first and second paths;

displacing means for moving said movable means;

a plurality of juxtaposed conveyor means each having a conveying surface extending laterally from one end to the other end of said plate such that said first path is located between said one end and said other end while said second path is located spaced from said first path and between said one end and said other end, each of said conveyor surfaces being disposed above said plate and arranged so that a total length of said conveying surfaces in the longitudinal direction of said plate is greater than a distance between said first and second locations of said plate, said conveying surfaces being movable independently from each other in the lateral direction of said plate and having a reference path between said one end and said other end;

a plurality of drive means, corresponding in number to said plurality of conveyor means, for moving corresponding conveying surfaces in the lateral direction of said plate;

a plurality of detector means, corresponding in number to said plurality of endless conveyor means, for detecting whether or not sad edge (DA) of said flexible sheet on respective conveyor means is present on said reference path; and control means coupled to said plurality of detector means and said plurality of drive means for controlling respective drive means such that each of said conveying surfaces moves in a direction from said first path to said second path when the corresponding detector means detects the presence of the edge (DA) of the flexible sheet on said reference path and in the direction from said second path to said first path when the corresponding detector means does not detect the presence of the edge (DA) of the flexible sheet on said reference path, whereby after one vertex (A) of the four vertexes (A through D) of the flexible sheet, held by said first holder and an intermediate portion (P) of an adjacent vertex (B) held by said second holder, have been move across said conveying surfaces from said first location to said second location upon an actuation of said displacing means, the edge (DA) of the flexible sheet is laterally displaced by said conveyor means so as to straighten the edge (DA) in parallel with said reference

4. The device as claimed in claim 3, further comprising sensor means for sensing a passage of a trailing edge (CD) of the flexible sheet through said first location, said sensor means being coupled to said control means so that when said sensor means senses the passage of said trailing edge (CD), said displacing means stops the movement of said movable means and said plurality of conveying means.

* * * * *

UNITED STATES PATENT AND TRADEMARK OFFICE

CERTIFICATE OF CORRECTION

PATENT NO. : 5,179,795

DATED : January 19, 1993

INVENTOR(S) : NAKAMURA et al

It is certified that error appears in the above-identified patent and that said Letters Patent is hereby corrected as shown below:

IN THE ABSTRACT:

Line 3, delete --disclosed.--

Col. 3, line 9, delete "in".

Col. 8, line 25, delete "edge" and insert --edges--; and line 63, delete "sad" and insert --said--.

Col. 9, line 13, delete "move" and insert --moved--.

Col. 10, line 4, after "reference" insert --path.--.

Signed and Sealed this

Fourth Day of January, 1994

*Attest:*

Bruce Lehman

BRUCE LEHMAN

*Attesting Officer*

*Commissioner of Patents and Trademarks*